US008685180B2

(12) United States Patent
Ueno et al.

(10) Patent No.: US 8,685,180 B2
(45) Date of Patent: Apr. 1, 2014

(54) IRON-BASED ALLOY POWDER

(75) Inventors: Hideo Ueno, Tochigi (JP); Yuji Soda, Tochigi (JP); Hironori Hideshima, Fukushima (JP)

(73) Assignee: Mitsubishi Steel Mfg. Co., Ltd., Tokyo (JP)

( * ) Notice: Subject to any disclaimer, the term of this patent is extended or adjusted under 35 U.S.C. 154(b) by 101 days.

(21) Appl. No.: 12/918,483

(22) PCT Filed: Feb. 19, 2009

(86) PCT No.: PCT/JP2009/052921
§ 371 (c)(1),
(2), (4) Date: Aug. 19, 2010

(87) PCT Pub. No.: WO2009/104692
PCT Pub. Date: Aug. 27, 2009

(65) Prior Publication Data

US 2010/0316523 A1 Dec. 16, 2010

(30) Foreign Application Priority Data

Feb. 20, 2008 (JP) ..... 2008-039420

(51) Int. Cl.
*C22C 38/12* (2006.01)

(52) U.S. Cl.
USPC ..... 148/328; 75/246; 148/336; 420/95; 420/96; 420/98

(58) Field of Classification Search
USPC ..... 75/255, 338; 420/95, 96, 98, 119, 123
See application file for complete search history.

(56) References Cited

U.S. PATENT DOCUMENTS 3,294,527 A * 12/1966 Floreen et al. ..... 420/98
4,098,607 A * 7/1978 Rizzitano et al. ..... 75/243

(Continued)

FOREIGN PATENT DOCUMENTS

DE 19828687 A1 1/1999
EP 1111080 A2 6/2001

(Continued)

OTHER PUBLICATIONS

International Search Report in corresponding PCT/JP2009/052921 dated May 19, 2009 (English and Japanese).

(Continued)

*Primary Examiner* — George Wyszomierski
(74) *Attorney, Agent, or Firm* — Marshall, Gerstein & Borun LLP

(57) ABSTRACT

A powder for a sintered valve sheet made of an iron-based alloy is provided, which has excellent compactibility and abrasion resistance and from which a carbide that may abrade a counterpart is not precipitated. A powder is provided, wherein a molten steel, in which carbon is controlled to be less than 0.1% by mass to avoid precipitation of a carbide, 0.5 to 8.5% by mass of Si, 10 to 25% by mass of Ni, 5 to 20% by mass of Mo, and 5 to 20% by mass of Co are contained, and a remainder includes Fe and incidental impurities, is rapidly cooled by a conventional technique such as a gas atomization method, a water atomization method, or a centrifugal force atomization method, so that a supersaturated solid solution of the alloy elements consisting mainly of austenite, which is effective in softening the powder, is formed. Since the powder has low hardness, the compactibility is excellent at the time of compression molding. On the other hand, since the powder is hardened after sintering, a valve sheet as a final product has excellent abrasion resistance. In addition, since no carbide is precipitated, the counterpart may not be abraded.

4 Claims, 5 Drawing Sheets

(56) References Cited

U.S. PATENT DOCUMENTS

| | | | | |
|---|---|---|---|---|
| 5,538,683 | A * | 7/1996 | Pinnow et al. | 419/49 |
| 6,082,317 | A | 7/2000 | Takahashi et al. | |
| 6,238,455 | B1 * | 5/2001 | Brown et al. | 75/243 |
| 6,767,414 | B2 * | 7/2004 | Uehara et al. | 148/318 |
| 2004/0103753 | A1 | 6/2004 | Ando | |
| 2004/0194576 | A1 | 10/2004 | Ando et al. | |

FOREIGN PATENT DOCUMENTS

| | | | |
|---|---|---|---|
| EP | 1930456 | A2 | 6/2008 |
| JP | 53-112206 | A | 9/1978 |
| JP | 2001279386 | A | 10/2001 |
| JP | 2002363681 | A | 12/2002 |
| JP | 2004156101 | A | 6/2004 |
| JP | 2004307950 | A | 11/2004 |
| JP | 2006299404 | A | 11/2006 |
| JP | 2008183931 | A | 8/2008 |

OTHER PUBLICATIONS

Written Opinion Report in corresponding PCT/JP2009/052921 dated Apr. 28, 2009 (Japanese only).

Sercombe, Sintering of freeformed maraging steel with boron additions, Mater. Sci. Eng. A, 363: 242-52 (2003).

Supplementary European Search Report from corresponding European Application No. EP09712175 dated Apr. 26, 2012.

Notice of Reasons for Rejection in JP Application No. 2008-039420 dated Oct. 30, 2012.

"Microstructures and mechanical properties of HIP consolidated 18% Ni maraging steel", Komatsubara et al. Powder Metallurgy vol. 30 No. 2, pp. 119-124, 1987.

* cited by examiner (SINTERING THERMAL TREATMENT IS PERFORMED IN NITROGEN ATMOSPHERE)

IRON-BASED ALLOY POWDER

TECHNICAL FIELD

The present invention relates to an iron-based alloy sintering powder, and more particularly, to a powder that is favorable for forming a sintered valve sheet made of an iron-based alloy powder in an internal-combustion engine.

BACKGROUND ART

Recently, engines with high power and increased fuel efficiency have been configured in order to reduce $CO_2$ emissions. Therefore, valve sheets for internal-combustion engines have been used in such a severe environment as a high temperature and a low lubrication, and various approaches have been made.

For example, Japanese Patent Application Laid-Open (JP-A) No. 2006-299404 proposes a material which includes hard particles of 10 to 60% by weight in a matrix phase, wherein the matrix phase contains 0.3 to 1.5% of C and of one or two or more selected from Ni, Co, Mo, Cr, and V in a total amount of 1 to 20%; and the hard particles have a composition which includes one or two or more among an intermetallic compound containing Fe, Mo, and Si as main components, an intermetallic compound containing Co, Mo, and Si as main components, and an intermetallic compound containing Ni, Mo, and Si as main components, which includes 1 to 15% of Si and 20 to 60% of Mo, which includes 10 to 70% of one or two or more selected from Cr, Ni, Co, and Fe, and of which the remaining portions are Fe and incidental impurities; and have a Vickers' hardness of 500 HV 0.1 to 1200 HV 0.1: has a density is 6.7 g/cm$^3$ or more: and has a radial crushing strength of 350 MPa or more.

In addition, JP-A No. 2004-307950 proposes an iron-based sintered alloy obtained by dispersing 3 to 20% by mass of hard particles relative to the total mass of the matrix in a matrix containing 3 to 12% of Ni, 3 to 12% of Mo, 0.1 to 3% of Nb, 0.5 to 5% of Cr, 0.6 to 4% of V, 0.5 to 2% of C, Fe, and incidental impurities.

In addition, in JP-A No. 2004-156101, it is proposed that hard particles include 20 to 70% by weight of Mo, 0.2 to 3% by weight of C, 1 to 15% by weight of Mn, and Fe, incidental impurities and Co as the remaining portion; and that the sintered alloy has overall components including 4 to 35% by mass of Mo, 0.2 to 3% by mass of C, 0.5 to 8% by mass of Mn, 3 to 40% by mass of Co, and incidental impurities and Fe as the remaining portion; where the base component includes 0.2 to 5% of C, 0.1 to 10% of Mn, and incidental impurities and Fe as the remaining portion, and the hard particle component includes 20 to 70% of Mo, 0.2 to 3% of C, 1 to 20% of Mn, and incidental impurities and Co as the remaining portion; and the hard particles are dispersed in the base in an area ratio of 10 to 60%.

In addition to the aforementioned patent documents, there have been many disclosures in the related technical field. However, any disclosure concerning characteristics other than chemical components regarding a powder for forming a valve sheet is not found. The inventors have been confronted with an incompatible problem that the powder needs to be softened so as to improve the compactibility of a powder for the sintered valve sheet made of an iron-based alloy and the powder also needs to be hardened so as to improve the abrasion resistance. The reasons are as follows.

First, in addition to high strength, the valve sheet is required to have good thermal conductivity so as not to store heat of the combustion in the engine in the valve sheet itself.

Therefore, the sintering density needs to be high. In order to increase the sintering density, the density of the compressed powder before the sintering needs to be high. In order to increase the density of the compressed powder before the sintering, the compactibility at the time of the compression molding needs to be good. In order to increase the compactibility, the hardness of the powder needs to be decreased.

However, if the hardness of the powder is decreased, the hardness of the valve sheet that is the final product after the sintering is decreased, so that the abrasion resistance deteriorates. In addition, for makers of sintered parts of the valve sheets, it is feared that when a carbide having different deformability from the metal is precipitated so as to increase the abrasion resistance, the counterpart may be abraded.

DISCLOSURE OF THE INVENTION

Problems to be Solved by the Invention

The present invention provides an iron-based alloy sintering powder, which has excellent compactibility and abrasion resistance and from which a carbide that may abrade a counterpart is not precipitated.

Means for Solving the Problems

In order to solve the above-mentioned problem, the inventors of the present invention have focused on a technical thought of a conventional maraging steel. The maraging steel is a precipitation-hardened steel obtained by solving an alloy element, which increases hardness as a precipitate, into martensite at the room temperature in a supersaturated solid solution and increasing the temperature thereof. However, there is a problem in that the hardness of the martensite is too high to mold as a powder. In addition, there is a problem in that an ordinary maraging steel contains Ti and Al which become a nitride decreasing fatigue strength.

Therefore, in consideration of these problems, when the inventors manufactured a powder by rapidly cooling a molten steel using a conventional method such as a gas atomization method, a water atomization method, or a centrifugal force atomization method, the inventors succeeded in obtaining a supersaturated solid solution which does not turn into martensite but remains as soft austenite, by adjusting the chemical components of the molten steel, which does not contain Ti and Al. Since the powder of the supersaturated solid solution has low hardness at the time of compression molding at room temperature, the compactibility is improved. Particularly, since the powder is hardened during the heating and cooling process at the time of sintering as the valve sheet, the abrasion resistance is improved. The metallurgical mechanisms of this phenomenon are as follows.

By adding an alloy element which decreases the Ms point, that is, the temperature at which austenite is transformed into martensite and rapidly cooling the molten steel, the supersaturated solid solution is formed, whereby the austenite can be obtained at room temperature. During the sintering, the alloy element which is supersaturated in the austenite is precipitated, whereby a precipitate having high hardness can be formed. At the same time, the alloy element which decreases the Ms point is extracted from the austenite, so that the Ms point of the austenite can be increased. Accordingly, at the time of cooling, the steel becomes martensite.

Therefore, the aforementioned object of the present invention is achieved by the following iron-based alloy sintering powder.

The invention provides an iron-based alloy sintering powder, wherein a molten steel, in which carbon as an incidental impurity element is controlled to be less than 0.1% by mass, 0.5 to 8.5% by mass of Si, 10 to 25% by mass of Ni, 5 to 20% by mass of Mo, and 5 to 20% by mass of Co are contained, and remainders are Fe and incidental impurities, is rapidly cooled, so that the hardness of the powder at the time of compression molding is less than 250 HV as Vickers hardness, while sintering hardness after sintering is 450 HV or more as Vickers hardness.

Effect of the Invention

According to the iron-based alloy sintering powder of the present invention, it is possible to provide an iron-based alloy sintering powder, which has excellent compactibility and abrasion resistance and from which a carbide that may abrade a counterpart is not precipitated and, more particularly, to provide an iron-based alloy sintering powder which is suitable for a valve sheet of an internal-combustion engine.

BEST MODE FOR CARRYING OUT THE INVENTION

Figure 1:
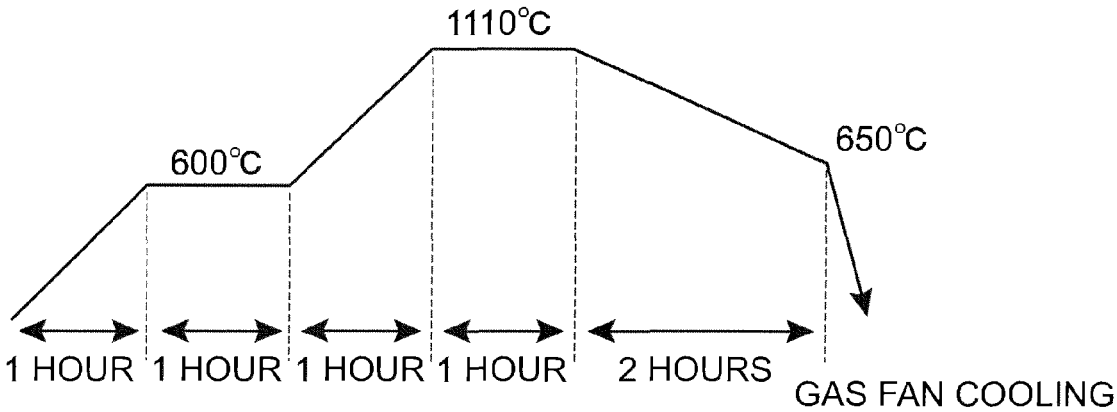
FIG. 1 is a view for explaining conditions of sintering thermal treatment in examples of the present invention.

Hereinafter, proffered exemplary embodiments of the present invention will be described.

The present invention provides an iron-based alloy sintering powder, in which a molten steel, in which carbon as an incidental impurity element is controlled to be less than 0.1% by mass to avoid precipitation of a carbide, 0.5 to 8.5% by mass of Si, 10 to 25% by mass of Ni, 5 to 20% by mass of Mo, and 5 to 20% by mass of Co are contained, and the remainder includes Fe and incidental impurities, is rapidly cooled, whereby a supersaturated solid solution is mainly austenite that is effective in softening the powder.

The reasons for the limitation of the configuration of the present invention are as follows.

C: less than 0.1% by Mass

C is an element constituting a carbide. As worried by makers of sintered parts of valve sheets, the carbide abrades a counterpart. In order to avoid the adverse effect, C needs to be less than 0.1% by mass. In addition, the occurrence of the carbide is not preferable in terms of the following two points.

In the valve sheet itself as well as the counterpart, the carbide has a deformability different from that of a surrounding metal. Therefore, when stress is exerted thereon, distortion occurs in the interface between the metal and the carbide, so that peeling may occur.

Due to the existence of the carbide, the thermal conductivity is lowered in comparison with the metal. Therefore, heat generated by the combustion in the engine is not easily released to a cylinder block, so that heat load to the valve sheet may be increased.

Therefore, C is limited to be less than 0.1% by mass.

Si: 0.5 to 8.5% by Mass

Si is an alloy element which becomes a precipitate with Mo described later from a supersaturated solid solution during the sintering. In order to ensure the effect, the amount of Si needs to be 0.5% by mass or more. On the other hand, Si is the alloy element, which increases the hardness of the powder. The excessive addition thereof increases the hardness of the powder at the time of the molding. In order to avoid the adverse effect, the amount of Si needs to be 8.5% by mass or less.

Therefore, the amount of Si is limited to be 0.5 to 8.5% by mass.

Ni: 10 to 25% by Mass

Ni is an element constituting austenite and, at the same time, an alloy element capable of maintaining a hardness of a powder to be low by ensuring soft austenite at the room temperature by decreasing the Ms point. In order to ensure the effect, the amount of Ni needs to be 10% by mass or more. On the other hand, Ni is the alloy element, which decreases the hardness of the powder. The addition thereof is preferable at the time of the molding. However, the excessive addition thereof decreases also the hardness of the powder after the sintering. In order to avoid the adverse effect, the amount of Ni needs to be 25% by mass or less. In addition, since Ni is an expensive alloy element, the excessive addition is not preferable.

Therefore, the amount of Ni is limited to be 10 to 25% by mass.

Mo: 5 to 20% by Mass,

Mo is an alloy element which becomes a precipitate with the above-described Si from a supersaturated solid solution during the sintering, at the same time, an alloy element which ensures soft austenite at the room temperature by decreasing the Ms point. In order to ensure the effect, the amount of Mo needs to be 5% by mass or more. On the other hand, Mo is the alloy element, which increases the hardness of the powder. The excessive addition thereof increases the hardness of the powder at the time of the molding. In order to avoid the adverse effect, the amount of Mo needs to be 20% by mass or less. In addition, since Mo is an expensive alloy element, the excessive addition is not preferable.

Therefore, the amount of Mo is limited to be 5 to 20% by mass.

Co: 5 to 20% by Mass

Co is an alloy element which increases a solid solution amount of Si and Mo, which become a precipitate, into the austenite to facilitate precipitation of such a precipitate. In order to ensure the effect, the amount of Co needs to be 5% by mass or more. On the other hand, Co is the alloy element which increases the hardness of the powder. The excessive addition increases the hardness of the powder at the time of the molding. In order to avoid the adverse effect, the amount of Co needs to be 20% by mass or less. In addition, since Co is an expensive alloy element, the excessive addition is not preferable.

Therefore, the amount of Co is limited to be 5 to 20% by mass.

In the present invention, the hardness of the powder at the time of the compression molding is less than 250 HV. The hardness of the powder denotes a value measured according to a Vickers hardness test method defined by JIS Z 2244. In order to ensure the compactibility of the powder, the hardness of the powder at the time of the compression molding needs to be less than 250 HV. Therefore, the hardness of the powder at the time of the compression molding is limited to be less than 250 HV.

In the present invention, the sintering hardness after the sintering is 450 HV or more. The sintering hardness denotes a value of a sintered object, which was treated according to a process shown in FIG. 1, measured according to a Vickers hardness test method defined by JIS Z 2244. In order to ensure the abrasion resistance of the sintered object, the sintering hardness after the sintering needs to be 450 HV or more. Therefore, the sintering hardness after the sintering is limited to be 450 HV or more.

EXAMPLE

First, a steel having chemical components listed in Table 1 was melted in a high-frequency melting furnace, and the molten steel was rapidly cooled by a water atomization method, so that a powder was produced. The hardness of the powder as a powder at the time of the molding was measured. In addition, thermal treatment was performed according to the sintering thermal treatment conditions shown in FIG. 1, based on information from the makers of the sintered parts of the valve sheets, and the hardness of the powder after the sintering thermal treatment was measured. The results of the measurement are listed in Table 1.

Test Nos. 1 to 9 are examples of the present invention and are powders with limited chemical components. Therefore, the hardness of each of the powders is less than 250 HV, and the corresponding hardness after the sintering is 450 HV or more.

On the other hand, Test Nos. a to h are comparative examples and are powders which do not satisfy the limitations on chemical components. Therefore, the following findings are evident.

In Test No. a, the amount of Si is less than 0.5% by mass of the lower limit of the limitation range. Therefore, the precipitate is not sufficiently precipitated, whereby the hardness of the powder after the sintering thermal treatment is less than 450 HV.

In Test No. b, the amount of Si exceeds 8.5% by mass of the upper limit of the limitation range. Therefore, the hardness of the powder at the time of the molding is high, and the value thereof is 250 HV or more.

In Test No. c, the amount of Ni is less than 10% by mass of the lower limit of the limitation range. Therefore, it is estimated that the austenite is not formed and the Ms point is not sufficiently lowered, and the martensite is generated. Therefore, the hardness of the powder at the time of the molding is 250 HV or more.

In Test No. d, the amount of Ni exceeds 25% by mass of the upper limit of the limitation range. Therefore, the hardness of the powder is excessively decreased, so that the hardness of the powder after the sintering is less than 450 HV.

TABLE 1

| Test | Chemical Component (mass %) | | | | | Hardness of Powder at the Time of | Hardness of Powder after Sintering Thermal | |
|---|---|---|---|---|---|---|---|---|
| No. | C | Si | Ni | Mo | Co | Molding (HV) | Treatment (HV) | Remarks |
| 1 | 0.02 | 4.6 | 19.8 | 10.0 | 9.8 | 200 | 502 | Example of the Present Invention |
| 2 | 0.05 | 0.5 | 20.5 | 10.5 | 10.0 | 187 | 450 | Example of the Present Invention |
| 3 | 0.05 | 8.5 | 20.1 | 9.9 | 10.1 | 225 | 524 | Example of the Present Invention |
| 4 | 0.02 | 5.0 | 10.0 | 10.0 | 10.2 | 245 | 519 | Example of the Present Invention |
| 5 | 0.02 | 4.8 | 25.0 | 10.3 | 10.0 | 190 | 462 | Example of the Present Invention |
| 6 | 0.06 | 5.1 | 19.8 | 5.0 | 9.8 | 185 | 473 | Example of the Present Invention |
| 7 | 0.03 | 5.5 | 20.0 | 20.0 | 9.8 | 243 | 535 | Example of the Present Invention |
| 8 | 0.04 | 4.8 | 20.0 | 9.7 | 5.0 | 205 | 465 | Example of the Present Invention |
| 9 | 0.07 | 4.5 | 19.8 | 11.0 | 20.0 | 248 | 565 | Example of the Present Invention |
| a | 0.03 | 0.2 | 19.5 | 9.8 | 10.0 | 195 | 400 | Comparative Example |
| b | 0.05 | 9.2 | 20.0 | 11.0 | 10.5 | 269 | 535 | Comparative Example |
| c | 0.03 | 5.0 | 4.8 | 9.6 | 10.3 | 320 | 545 | Comparative Example |
| d | 0.02 | 4.7 | 30.1 | 9.9 | 9.8 | 165 | 413 | Comparative Example |
| e | 0.05 | 5.3 | 19.8 | 3.3 | 10.0 | 268 | 435 | Comparative Example |
| f | 0.02 | 5.2 | 19.9 | 24.9 | 9.8 | 293 | 565 | Comparative Example |
| g | 0.07 | 4.6 | 19.8 | 10.2 | 4.4 | 175 | 356 | Comparative Example |
| h | 0.03 | 4.8 | 20.2 | 10.0 | 25.0 | 325 | 525 | Comparative Example |

In Test No. e, the amount of Mo is less than 5% by mass of the lower limit of the limitation range. Therefore, it is estimated that the Ms point is not sufficiently lowered and the martensite is generated. Therefore, the hardness of the powder at the time of the molding is 250 HV or more.

In Test No. f, the amount of Mo exceeds 20% by mass of the upper limit of the limitation range. Therefore, the hardness of the powder at the time of the molding is high, and the value thereof is 250 HV or more.

In Test No. g, the amount of Co is less than 5% by mass of the lower limit of the limitation range. Therefore, the precipitate is not sufficiently precipitated, so that the hardness of the powder after the sintering thermal treatment is less than 450 HV.

In Test No. h, the amount of Co exceeds 20% by mass of the upper limit of the limitation range. Therefore, the hardness of the powder at the time of the molding is high, and the value thereof is 250 HV or more.

Figure 2:
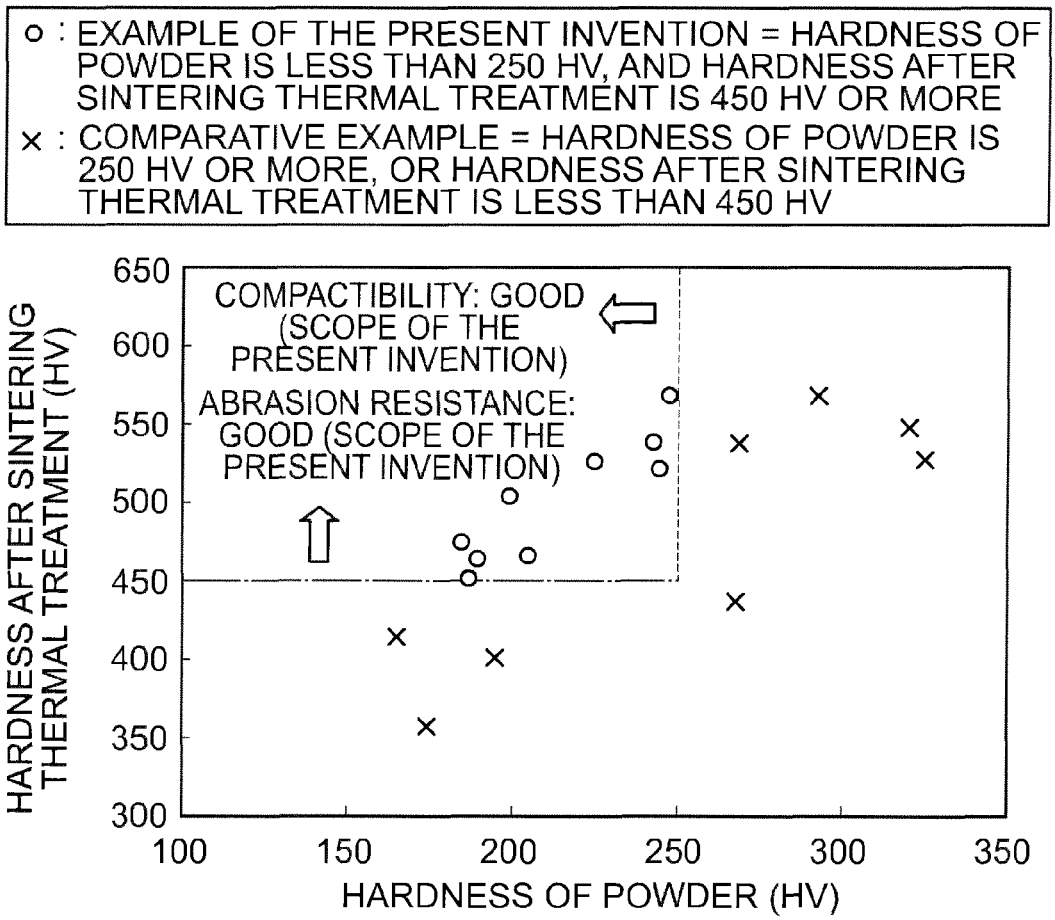
FIG. 2 is a graph showing relationships between hardness after sintering thermal treatment and hardness of a powder in examples of the present invention and comparative examples.

The effects of those tests are shown in FIG. 2. Thus, it was possible to provide a powder for a sintered valve sheet made of an iron-based alloy that had excellent compactibility and abrasion resistance and from which a carbide that may abrade a counterpart was not precipitated, which is the object of the present invention.

An example where the steel according to the present invention is used as hard particles of a valve sheet is described. Chemical components of estimated powders and hardness of the powders are listed in Tables 2 and 3.

The steel according to the present invention is a powder of Test No. 1 indicated as an example of the present invention in Table 1. In addition, although a Tribaloy alloy (registered trade mark, manufactured by DEROLO STELLITE) is a conventional Co-based powder for a valve sheet, makers of sintered parts of the valve sheets have pointed out that there is a problem in the compactibility due to the high hardness of the powder.

First, a steel having the chemical components listed in Table 2 was melted in a high-frequency melting furnace, and the molten steel was rapidly cooled by a water atomization method, so that a powder was produced. Next, 30% by mass of the powder, 68.25% by mass of iron powder as a base powder, 1% by mass of graphite powder, and 0.75% by mass of zinc stearate were mixed. The hardness of the iron powder is 70 HV. The mixture was supplied to a mold having an outer diameter of 21 mm and an inner diameter of 13.5 mm, so that a valve sheet having a height of 6 mm was molded with a pressure of 6 ton/cm$^2$.

For these molded objects, the relative pressed density was measured. The relative pressed density is a relative value obtained by regarding the density of an ideal molded object having no pores as 100% and comparing the density of an actual molded object therewith. If simply compared in terms of apparent density, a molded object of a powder having a high true density will have a high value even if the molded object has many pores. As a result, the compactibility cannot be evaluated. Therefore, the evaluation was performed with the relative pressed density. Although not included in the scope of the present invention, the relative pressed density is one of parameters indicating whether the compactibility is good or bad. It is estimated that as the relative pressed density is increased, the compactibility is improved. The results are listed in Table 2.

Figure 3:
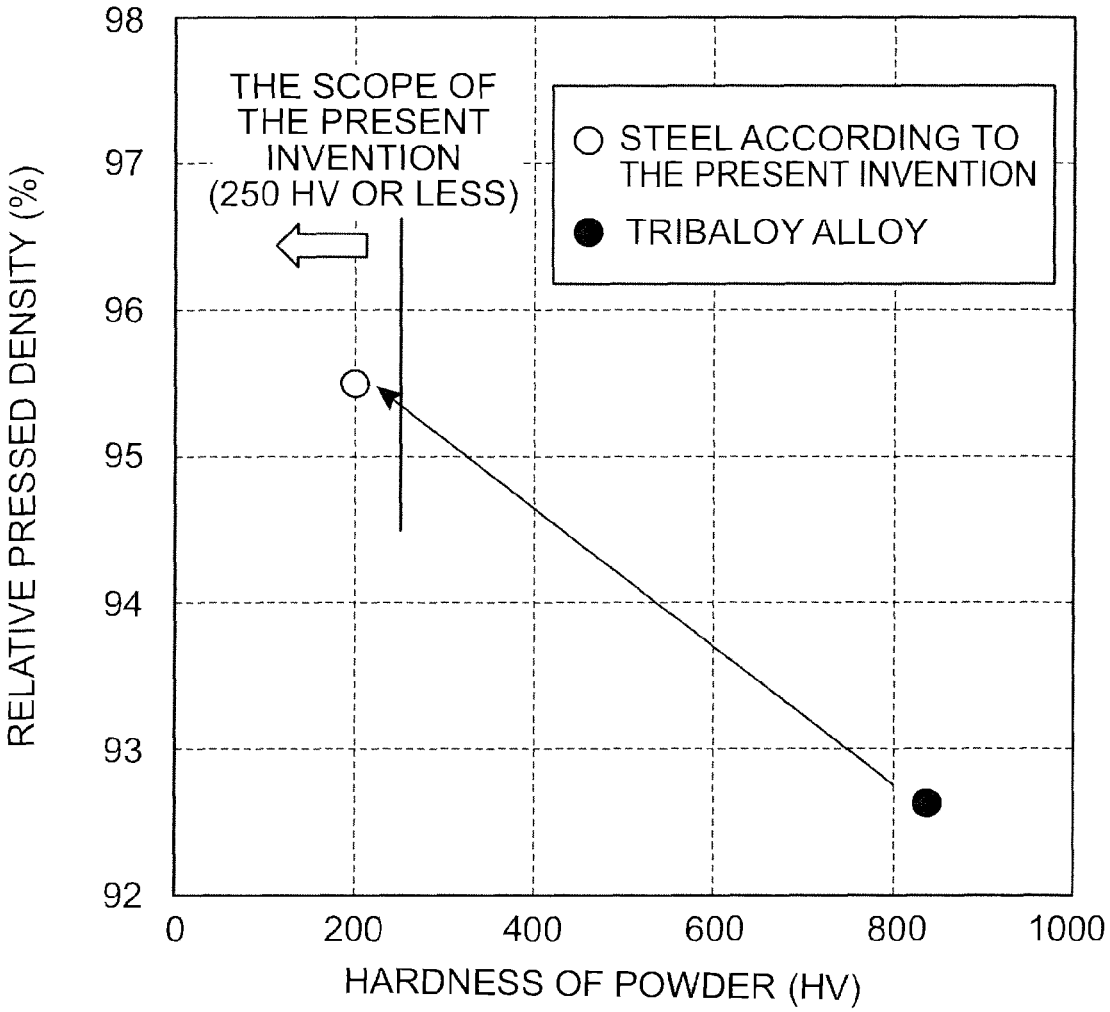
FIG. 3 is a graph showing a relationship between a relative pressed density of an evaluated powder and hardness of a powder at the time of molding.

Influence of the hardness of the powder at the time of the molding on the relative pressed density of the molded-object which is compressed and molded is shown in FIG. 3.

TABLE 2

| Evaluated Powder | Chemical Component (mass %) C | Si | Ni | Mo | Co | Hardness of Powder (HV) | Relative Pressed Density (%) |
|---|---|---|---|---|---|---|---|
| Steel according to the Present Invention | 0.02 | 4.6 | 19.8 | 10.0 | 9.8 | 200 | 95.5 |
| Tribaloy Alloy (Conventional Powder) | 0.03 | 2.5 | 0.0 | 27.4 | 58.0 | 836 | 92.6 |

Therefore, it can be understood that as the hardness of the powder at the time of molding is decreased, the relative pressed density is increased, and the steel according to the present invention satisfies the range of the present invention and the compactibility thereof is better than that of the Tribaloy alloy. In general, when the relative pressed density is 95% or less, the molding process includes two processes. However, since the relative pressed density of the steel according to the present invention is 95.5%, one process can be omitted.

Figure 4:
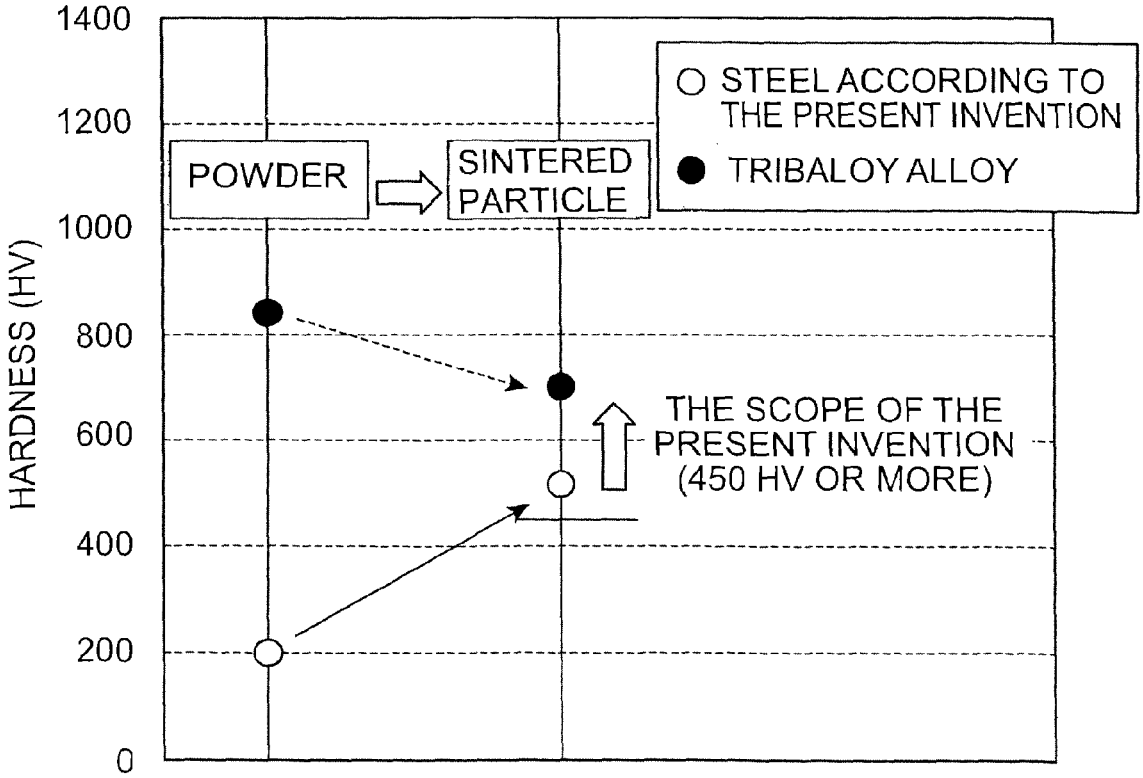
FIG. 4 is a graph showing a change in hardness of an evaluated powder from the time of molding to the time after sintering.

Next, sintering thermal treatment as shown in FIG. 1 was performed on the resulting molded objects, and the hardness of the hard particle portion was measured. The results are listed in Table 3. The change in hardness of the evaluated powders from the time of the molding to the time after the sintering is shown in FIG. 4. Thus it is recognized that the hardness of the steel according to the present invention increases after the sintering.

TABLE 3

| Evaluated Powder | Chemical Component (mass %) C | Si | Ni | Mo | Co | Hardness of Hard Particle Portion after Sintering (HV) | Hardness of Entire Valve Sheet (HRB) | Radial Crushing Strength of Valve Sheet (N/mm2) |
|---|---|---|---|---|---|---|---|---|
| Steel according to the Present Invention | 0.02 | 4.6 | 19.8 | 10.0 | 9.8 | 508 | 90.6 | 459 |
| Tribaloy Alloy (Conventional Powder) | 0.03 | 2.5 | 0.0 | 27.4 | 58.0 | 697 | 78.3 | 353 |

Figure 5:
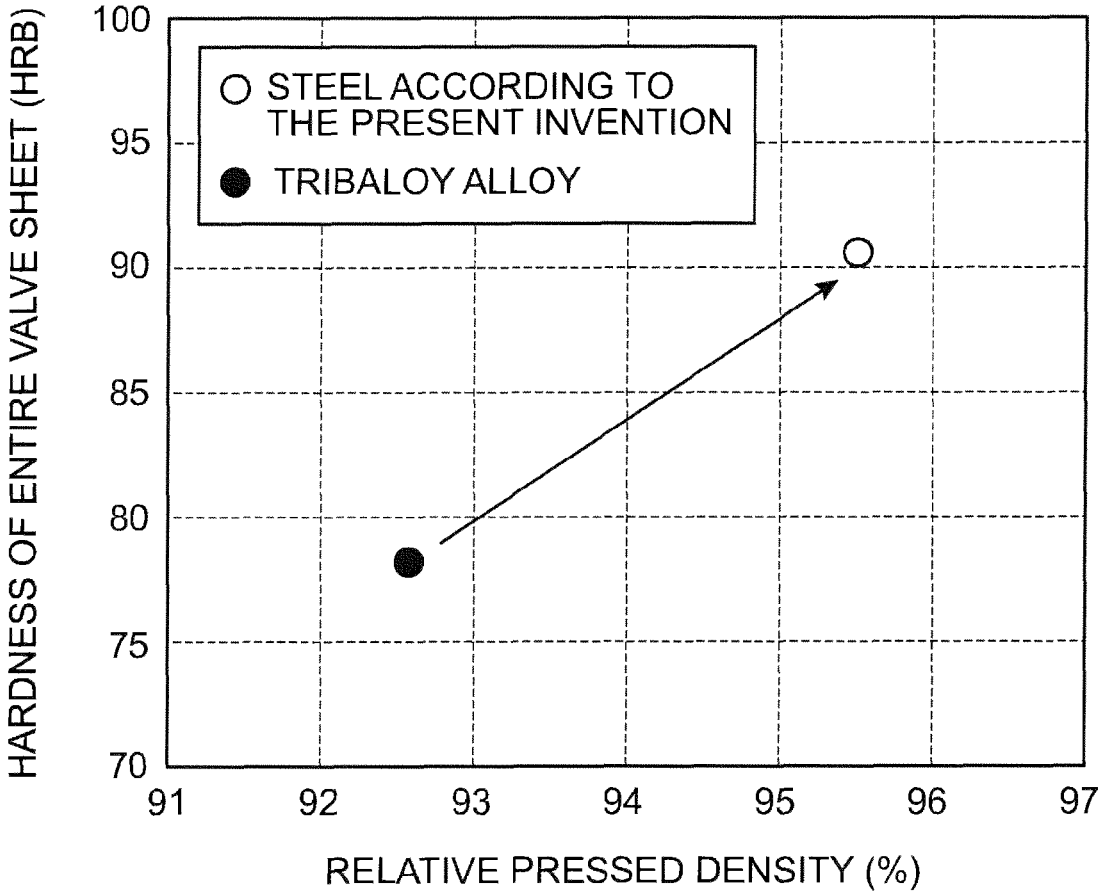
FIG. 5 is a graph showing a relationship between hardness of the entire valve sheet and a relative pressed density.

In addition, in order to evaluate the hardness of the entire valve sheet, a hardness test with Rockwell B scale was performed. The results are listed in Table 3. A relationship between the hardness of the entire valve sheet and a relative pressed density is shown in FIG. 5.

Figure 6:
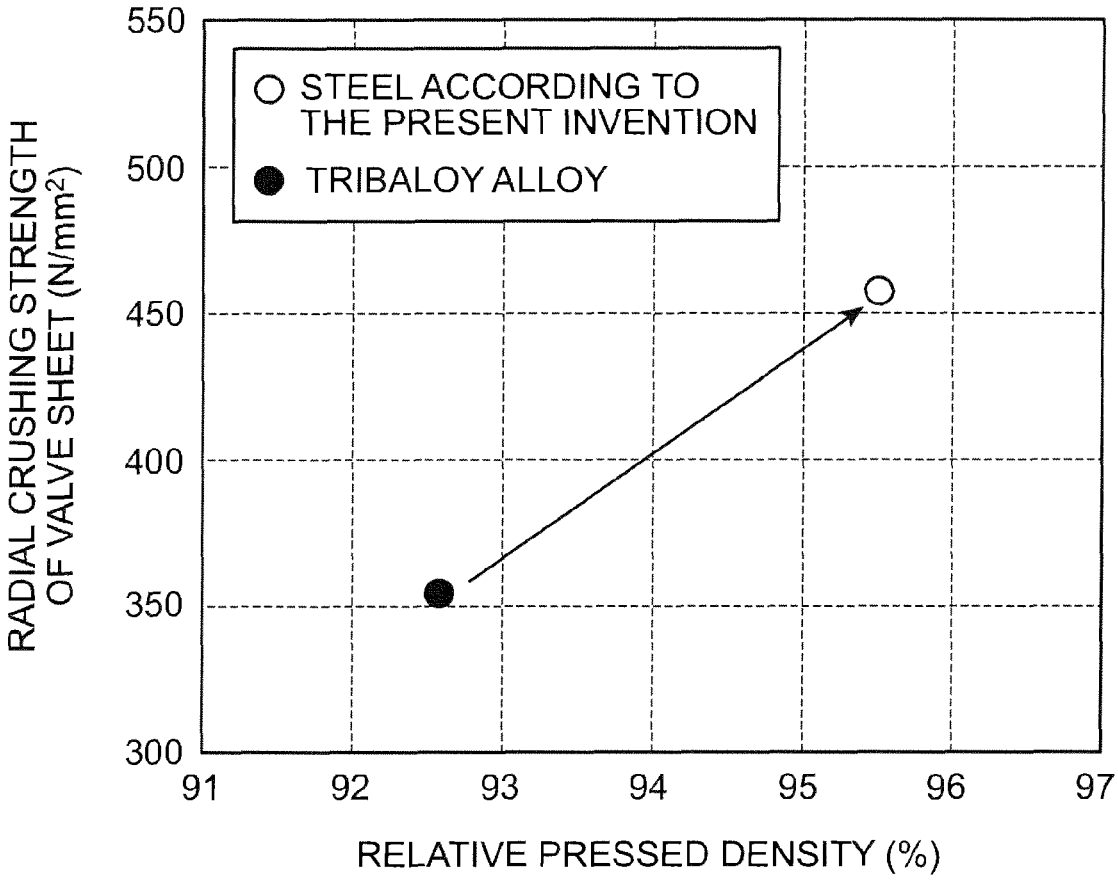
FIG. 6 is a graph showing a relationship between radial crushing strength of the valve sheet and a relative pressed density.

Thus although the steel according to the present invention has low hardness of the hard particles in comparison with the Tribaloy alloy, it is recognized that the hardness of the entire valve sheet is high, so that the abrasion resistance is estimated to be improved. This phenomenon is estimated to result from the fact that since the steel according to the present invention has good compactibility in comparison with the Tribaloy alloy and the molded-object has a high relative pressed density, the molded-object is densely sintered. In order to verify the estimation, a radial crushing strength was measured by exerting a load on the valve sheet from the upper and lower portions of the ring and calculating the strength from a crushed load. The results are listed in Table 3. A relationship between a radial crushing strength of the valve sheet and the relative pressed density is shown in FIG. 6.

Thus it can be recognized that the steel according to the present invention had a high radial crushing strength and is densely sintered in comparison with the Tribaloy alloy. Therefore, it can be recognized that, in the steel according to the present invention, the compactibility and the abrasion resistance can be simultaneously improved, which is an object of the present invention, and the application to the valve sheet is one of the best embodiments.

In addition, the iron-based powder according to the present invention, which is cheaper than a currently-used Co-based powder in terms of cost, has a great industrial advantage also in that the compactibility can be improved and substantially equivalent abrasion resistance can be ensured.

Hereinbefore, although the present invention is described with reference to a sintered valve sheet made of an iron-based alloy in an internal-combustion engine, the present invention is not limited to the valve sheet, but it may be used in industrial fields of iron-based sintered alloy products such as gears, pulleys, shafts, bearings, and jigs, which require the compactibility and the abrasion resistance without occurrence of abrasion in a counterpart.

The invention claimed is:

1. An iron-based alloy powder, which comprises austenite and is produced by rapidly cooling a molten steel having a chemical composition consisting of less than 0.1% by mass of carbon, 0.5 to 8.5% by mass of Si, 10 to 25% by mass of Ni, 5 to 20% by mass of Mo, and 5 to 20% by mass of Co, with a remainder comprising Fe and incidental impurities, wherein the Vickers hardness of the powder is less than 250 HV and the powder is capable of achieving a Vickers hardness after sintering of 450 HV or more.

2. The iron-based alloy powder according to claim 1, being a powder used for forming a sintered valve sheet in an internal-combustion engine.

3. An iron-based alloy powder, which is produced by rapidly cooling a molten steel having a chemical composition consisting of less than 0.1% by mass of carbon, 0.5 to 8.5% by mass of Si, 10 to 25% by mass of Ni, 5 to 20% by mass of Mo, and 5 to 20% by mass of Co, with a remainder comprising Fe and incidental impurities, wherein, the Vickers hardness of the powder is less than 250 HV, and the powder is capable of achieving a Vickers hardness after sintering of 450 HV or more, wherein during sintering, the powder is capable of forming a hard precipitate as a result of precipitation of an alloy element which is supersaturated in austenite of the powder, and the powder is capable of forming martensite by the cooling after sintering.

4. The iron-based alloy powder according to claim 3, being a powder used for forming a sintered valve sheet in an internal-combustion engine.

* * * * *